US006042408A

United States Patent [19]

Noro

[11] Patent Number: 6,042,408

[45] Date of Patent: Mar. 28, 2000

[54] CONNECTOR FOR FLAT CONDUCTIVE PATH

[75] Inventor: Yutaka Noro, Yokkaichi, Japan

[73] Assignee: Sumitomo Wiring Systems, Ltd., Japan

[21] Appl. No.: 09/075,213

[22] Filed: May 11, 1998

[30] Foreign Application Priority Data

May 13, 1997 [JP] Japan ..... 9-122503

[51] Int. Cl.[7] ..... H01R 9/07

[52] U.S. Cl. ..... 439/260; 439/266; 439/492

[58] Field of Search ..... 439/260, 261, 439/266, 267, 270, 492–499, 67

[56] References Cited

U.S. PATENT DOCUMENTS 4,270,826 6/1981 Narozny .
5,695,359 12/1997 Fujikura et al. ..... 439/495
5,695,360 12/1997 Seto et al. ..... 439/495
5,873,739 2/1999 Roberts ..... 439/67

FOREIGN PATENT DOCUMENTS 91 15 545 3/1991 Germany .
8-279378 10/1996 Japan .

*Primary Examiner*—Lincoln Donovan
*Attorney, Agent, or Firm*—Banner & Witcoff, Ltd.

[57] ABSTRACT

An electrical connector for a ribbon cable comprises a housing (1) with a pivotable pressing member (3) movable from an open to a closed condition to clamp a cable (4). The pressing member has temporary stopping latch (37,50) to allow a substantially closed connector for transport for transport and attachment purposes, and a final stoping latch (37,51) for firm engagement with the cable (4).

15 Claims, 8 Drawing Sheets

CONNECTOR FOR FLAT CONDUCTIVE PATH

TECHNICAL FIELD

The present invention relates to an electrical connector to which a sheet-like electrically conductive path is attachable.

BACKGROUND TO THE INVENTION

A well-known example of a connector for a strip or sheet-like electrically conductive path is disclosed in the Laid-Open Publication Tokkaihei 8-279378. As shown in FIGS. 10 and 11 of this specification, a ribbon cable connector is provided with a plurality of terminals a housed in a parallel manner within a connector housing b, and a cover c which can be opened to a releasing position or closed to a pressing position with respect to the connector housing b. When the cover c is in the releasing position, a ribbon cable d can be inserted between the cover c and the terminal a. This ribbon cable d is clamped between the cover c and the terminal a when the cover c is closed to the pressing position, thus electrically connecting the ribbon cable d with terminal a. Locking members e and f are provided on the cover c and the housing b in order to retain the cover c in the pressing position.

It is desirable that the latching of the cover c is securely effected after the ribbon cable d has been connected, so that the connected state of the ribbon cable d can be maintained even if it is subjected to, for example, a pulling force. Before the ribbon cable d is connected, that is, while the housing b is being transported or while the housing b is being attached to a circuit board, it is customary for the cover c to be kept closed in the pressing position to facilitate handling. In order to connect the ribbon cable d, the cover d must be opened. However, there is the problem that if the locking of the cover c is secure, as mentioned above, it takes time to open the cover c, but if the operation of opening the cover c is given priority and the locking force of the cover c accordingly made weaker, the reliability of the connection is adversely affected.

The present invention has been developed after taking the above problem into consideration, and aims to provide connector for a sheet-like electrically conductive path in which the reliability of the connection is maintained, and in which a pressing member can easily be unlatched.

SUMMARY OF THE INVENTION

According to the invention there is provided an electrical connector for a flat conductor having an electrical path thereon, said connector comprising a housing, an electrical terminal in the housing, and a pressing member pivotally mounted on said housing and movable between an open condition in which a mouth of the connector is open to receive a flat conductor, and a closed condition in which said mouth is closed to clamp said conductor against said terminal, wherein said connector includes a temporary latch for holding said pressing member in a nearly closed condition, and a final latch for holding said pressing member in said closed condition, said temporary latch being weaker than said final latch.

Such a connector allows the pressing member to be temporarily latched for transport and assembly purposes, yet easily opened for insertion of the conductor, and prior to final latching. The connector consequently takes up less room for transport, is less likely to be damaged or tangled during transport, and is easy to manipulate during attachment to a substrate.

Preferably the temporary and final latch have a common latching member. One of the pressing member and housing may have a protrusion, and the other may have two recesses in series to define temporary and final latching positions.

Preferably the connector is of a resilient plastics material, and said latch is engageable by resilient deformation of one of the pressing member and housing.

In the case where the latch comprises a projection and recesses, the projection may more deeply engage the recess defining the final position, and thereby provide a more retentive latch. The projection and/or recess defining the temporary position may have chamfered edges to and engagement and disengagement thereof.

Latches may be provided on either side of the connector in order to provide secure retention of said pressing member.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 9.

Figure 1:
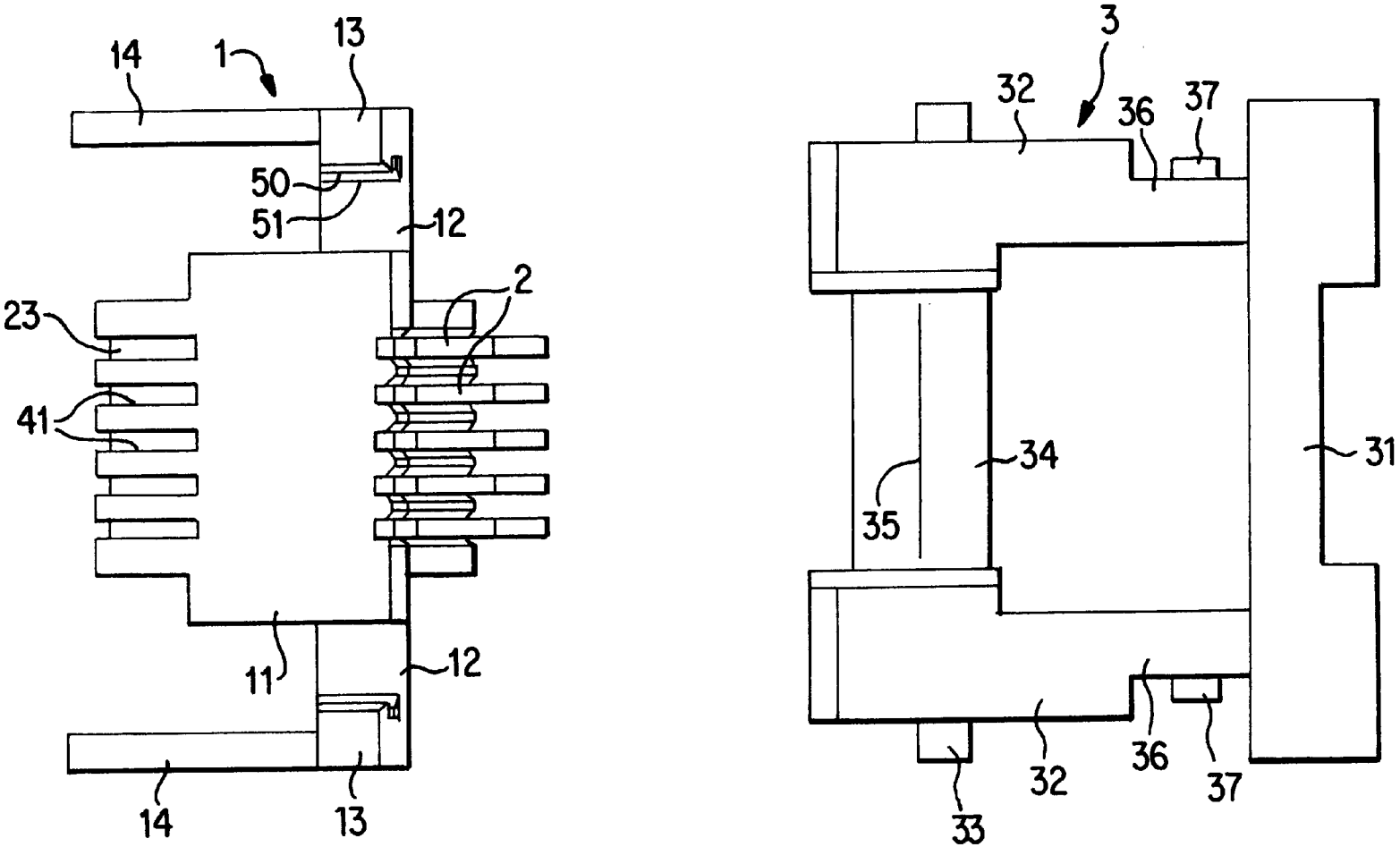
FIG. 1 is a plan view relating to embodiment 1 of the present invention showing a housing and a pressing member in a state prior to attachment.
Figure 10:
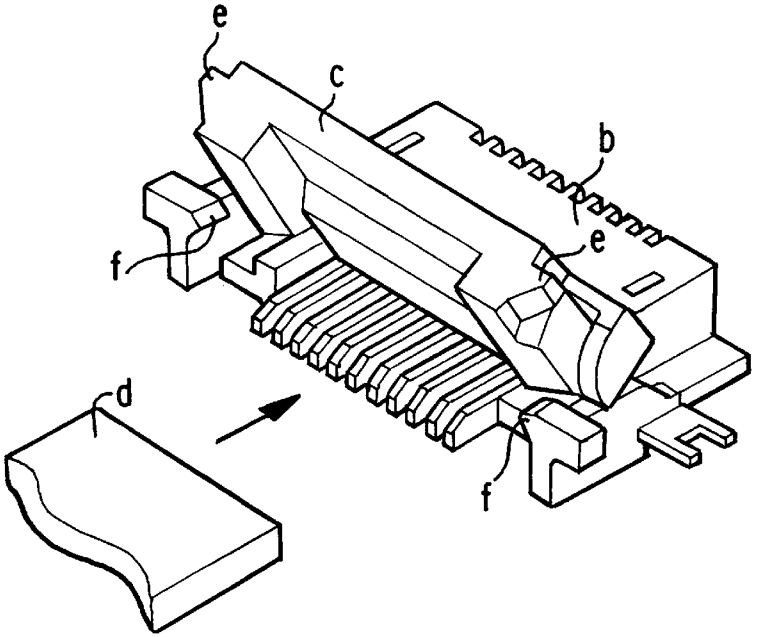
FIG. 10 PRIOR ART
FIG. 10 is a diagonal view of a prior art example.

As shown in FIG. 1, a connector comprises a connector housing 1, a plurality of terminals 2 attached to the housing 1, and a pressing member 3 attached in a pivotable manner to the housing 1. A sheet-like electrically conductive path suitable for use in this embodiment is a ribbon cable 4 comprising a flexible printed circuit or FPC (see FIG. 10), and has a configuration whereby the upper face of a bendable sheet-like base member has a plurality (five in the present embodiment) of evenly spaced conductive paths (not shown) formed thereon by a print distributing means, the anterior end of each conductive path making contact with contact members 24 of the terminals 2.

Figure 2A:
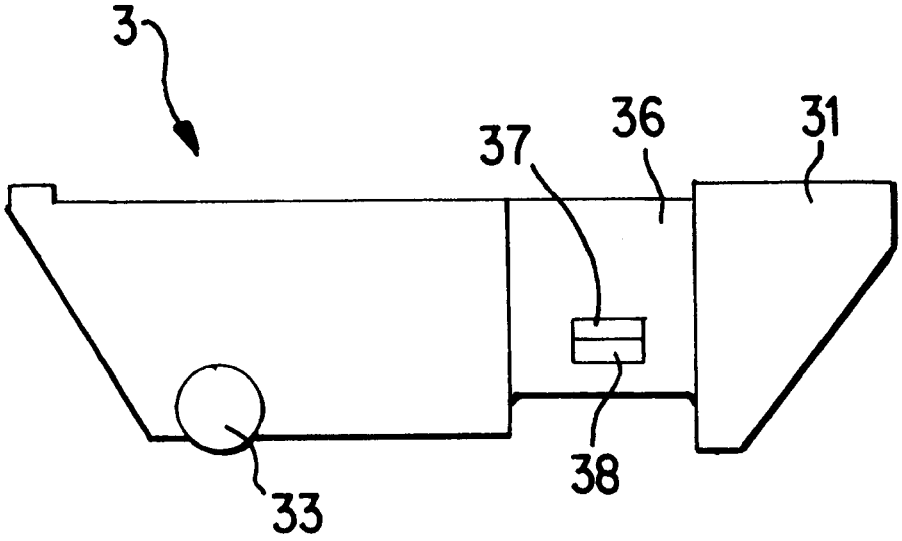
FIGS. 2*a* and 2*b* are side views of the present invention.
Figure 2B:
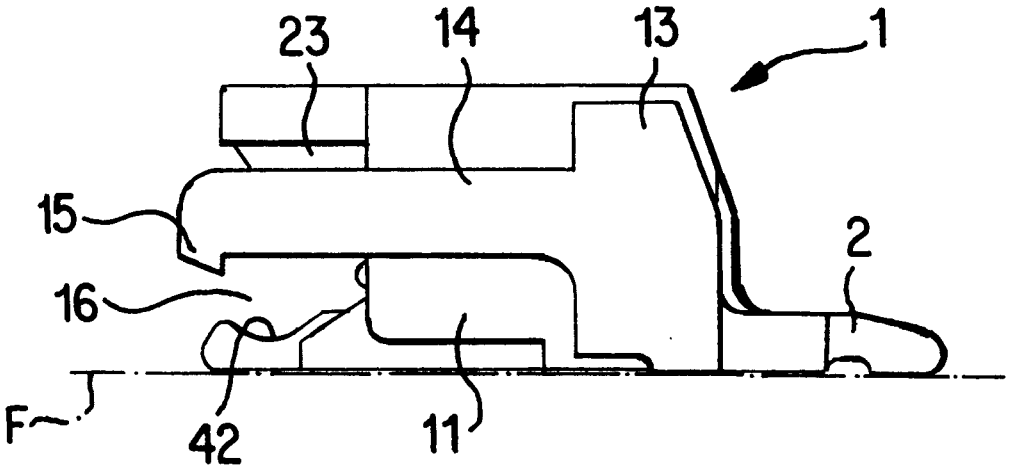
Figure 3:
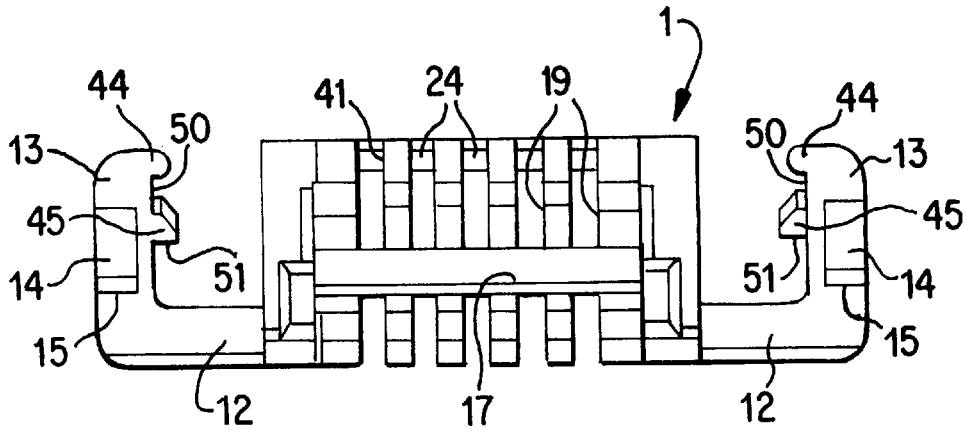
FIG. 3 is a front view of the housing unit.
Figure 4:
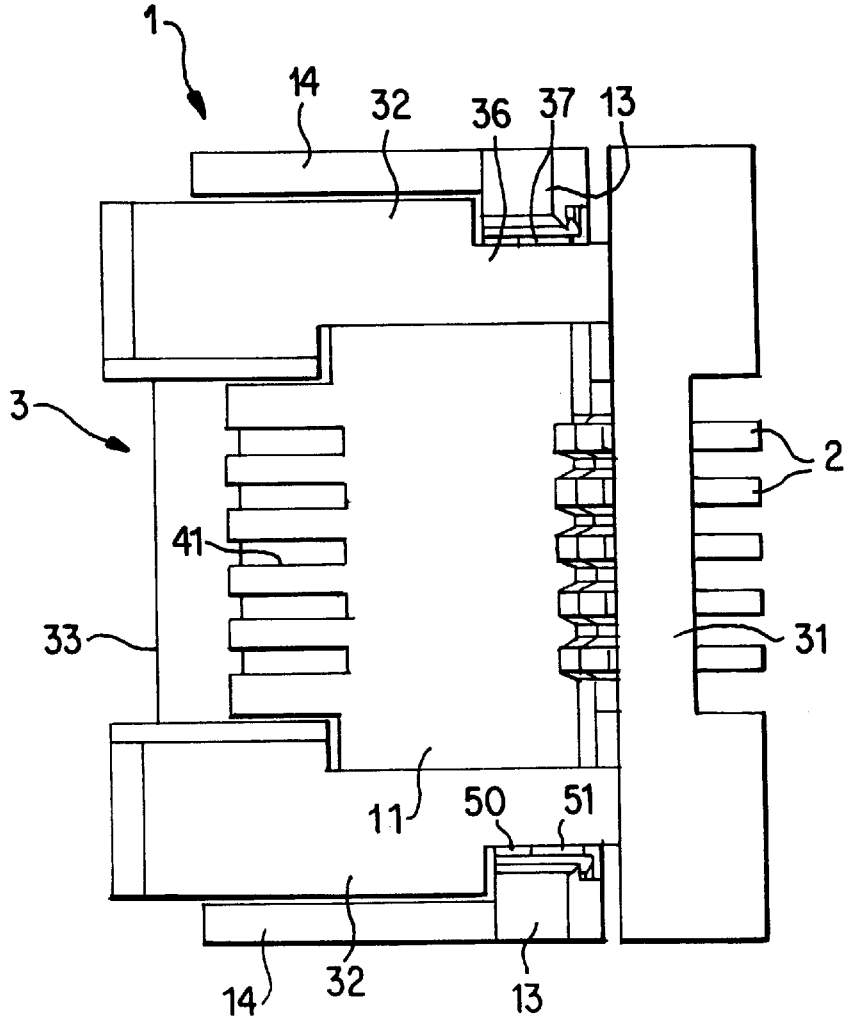
FIG. 4 is a plan view of the housing and the pressing member in an attached state.
Figure 5:
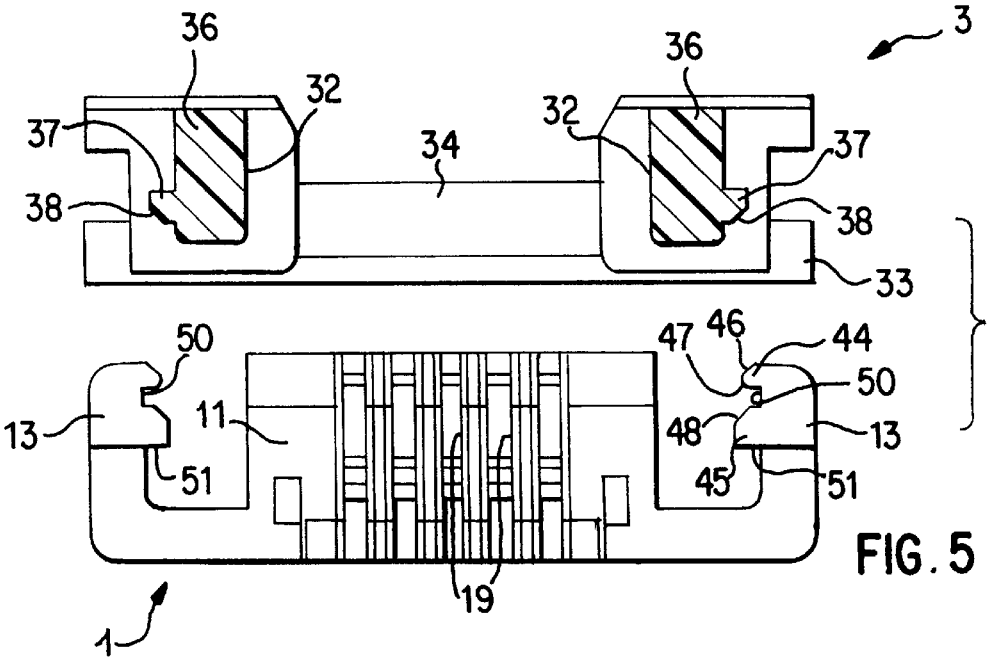
FIG. 5 is a partially cut away rear view of the housing and the pressing member.

The housing 1 is formed in a unified manner from synthetic resin and, as shown in FIGS. 1 and 2, has a block-like main body 11. As shown in FIG. 3, protruding members 12 protrude to the left and right sides from the lower portion of the posterior face of the main body 11 (the right side in FIG. 1), and locking columns 13 rise upwards from the protruding end of each protruding member 12. Axle receiving arms 14 protrude in an anterior direction from a portion that is approximately centrally located along the height of each locking column 13, each axle receiving arm 14 having a hook member 15 at its anterior end.

The anterior face of the main body 11 has an insertion aperture or mouth 16 for the ribbon cable 4. The mouth 16 is formed in the interior direction up to an approximately central location. Its insertion end has an opening that is wide and its interior end has a concave groove 17 that is slightly larger in dimension than the thickness of the ribbon cable 4 (see FIG. 8*b*). A plurality (five in the present embodiment) of parallel slit shaped cavities 19 pass between the anterior and posterior faces of the main body 11. These cavities 19 serve to house the terminals 2.

Figure 7A:
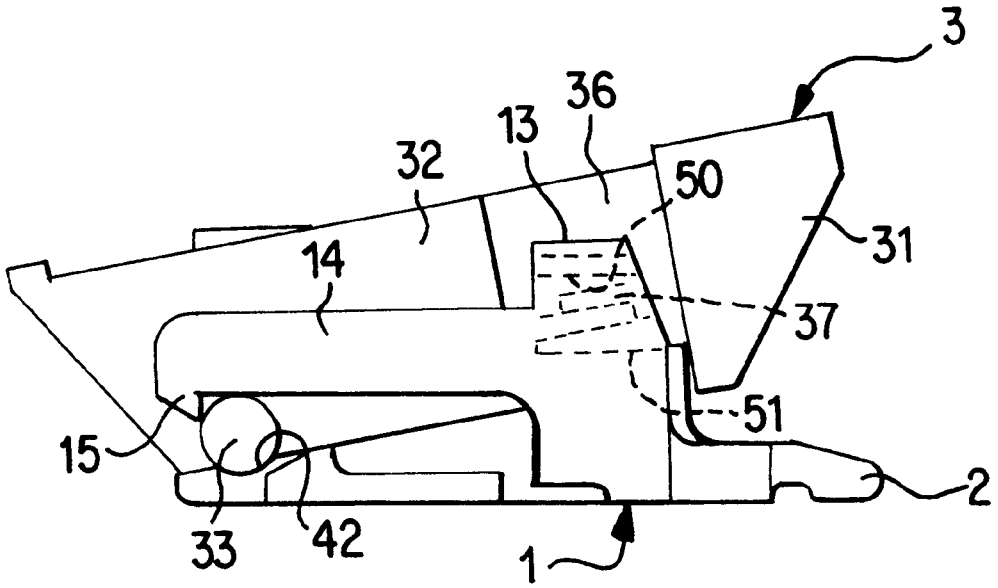
FIG. 7*a* is a side view of the pressing member in a temporary supporting position.
Figure 7B:
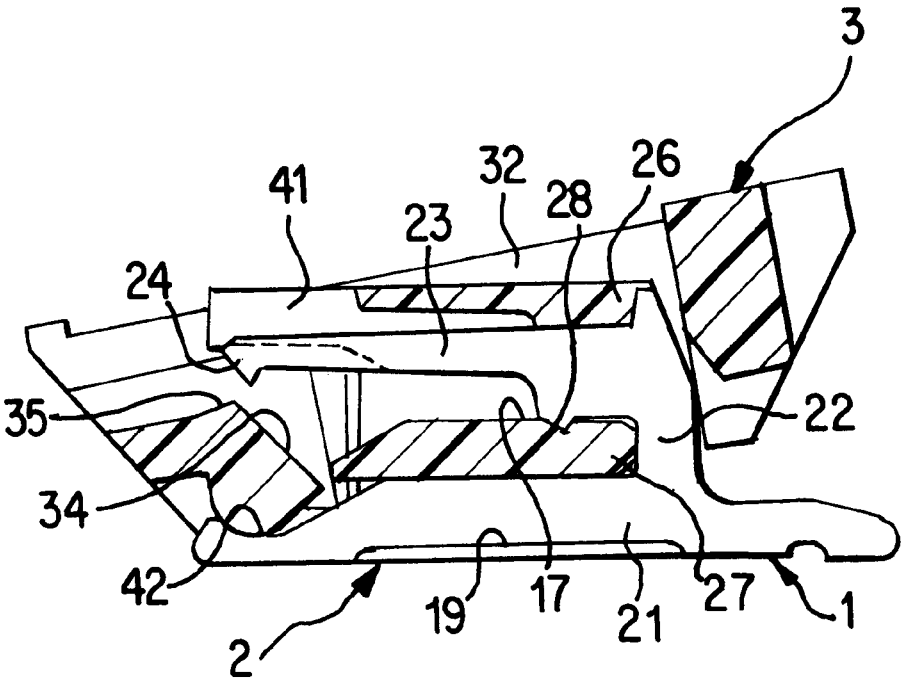
FIG. 7*b* is a cross-sectional view of FIG. 7*a*.

As shown in FIG. 7*b*, the terminal 2 has a configuration whereby a connecting member 22 rises upwards from the upper face of the posterior end of a base plate attachment member 21, the upper end of this connecting member 22 protrudes in an anterior direction and forms a resilient contact member 23. The terminal 2 is pushed into the cavity 19 from the posterior end and its position is fixed when specified parts of it come into contact with protruding members 26 and 27 of the cavity 19, and a protrusion 28 on the terminal 2 is caught by the inner wall of the cavity 19. The posterior end of each base plate attachment member 21 protrudes into the posterior end of the main body 11 of the housing 1, and is connected by means of soldering to the conductive path on the upper face F of a circuit board (FIG. 2*b*).

The contact member 23 can be moved in a resilient manner in an up-down direction and the anterior end thereof has a downwardly facing contact 24. A slit 41 is formed at the anterior edge of the ceiling portion of the main body 11 of the housing 1, this slit 41 permitting the resilient contact member 23 to move upwards in a resilient manner, and an arc shaped axle-receiving concave member 42 is formed in the upper face of the base portion of the main body 11.

The pressing member 3 is formed in a unified manner from synthetic resin. As shown in FIG. 1, it comprises a pair of levers 32 protruding from the left and right ends of a long and thin base member 31, these having a frame shape which surrounds, from the left and right side faces, the posterior face of the main body 11 of the housing 1. A pivot axle 33 formed in a unified manner passes through the anterior ends of the levers 32. Further, as shown in FIGS. 7*a* and 7*b*, that portion of the axle 33 which is located between the levers 32 is inserted into the axle-receiving concave member 42. Furthermore, as shown in FIG. 7*a*, the ends of the axle 33 which protrude from the side faces of the levers 32 fit with the interior sides of the hook members 15 of the arms 14. In this manner, the pressing member 3 is supported in the housing 1 in such a way that it can be rotated between the releasing position (shown in FIGS. 8*a* and 8*b*) and the pressing position (shown in FIGS. 9*a* and 9*b*).

Figure 8A:
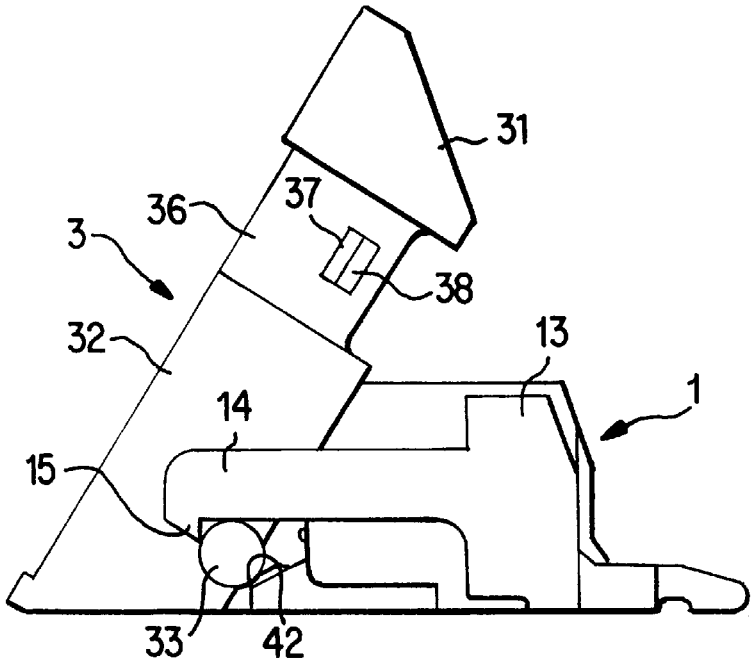
FIG. 8*a* is a side view of the pressing member in a releasing position.
Figure 8B:
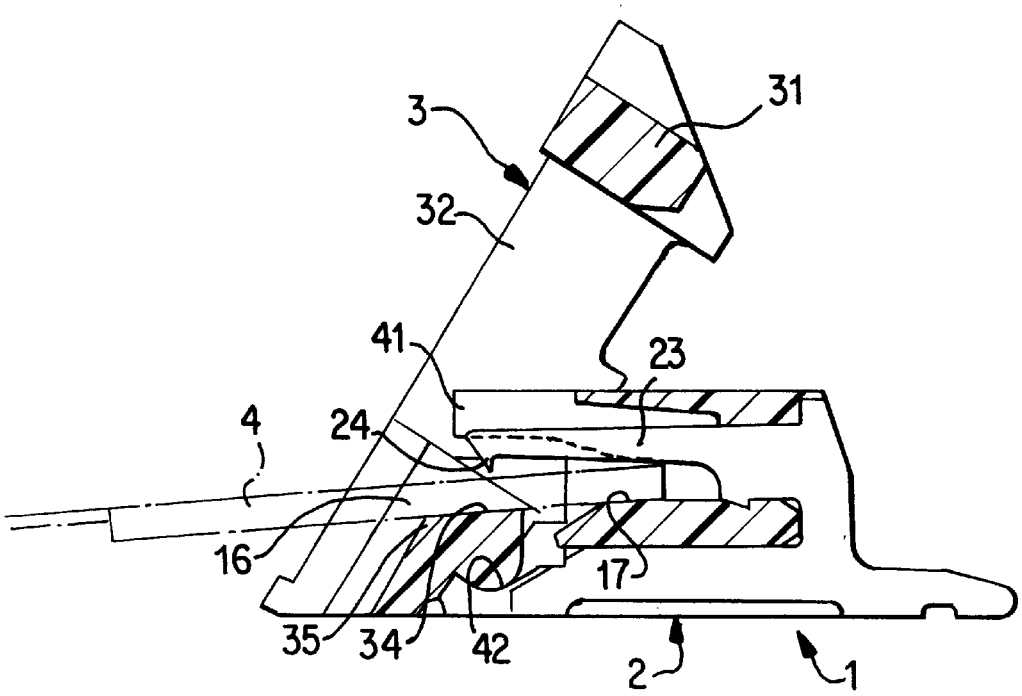
FIG. 8*b* is a cross-sectional view of FIG. 8*a*.
Figure 9A:
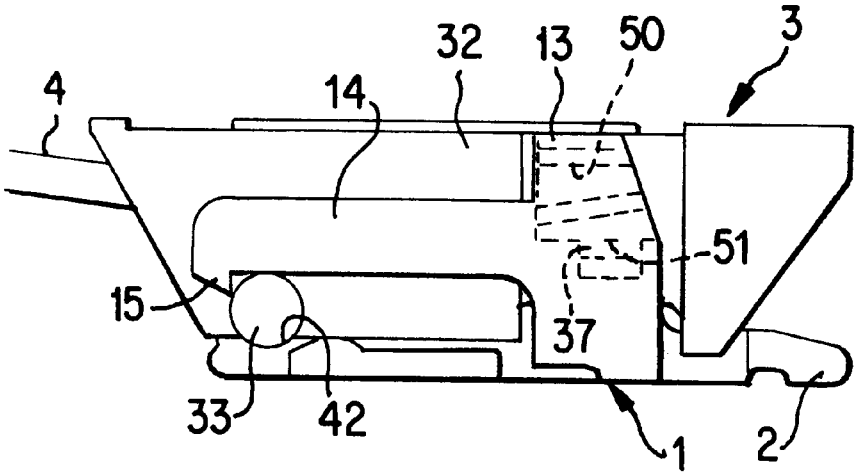
FIG. 9*a* is a side view of the pressing member in a pressing position.
Figure 9B:
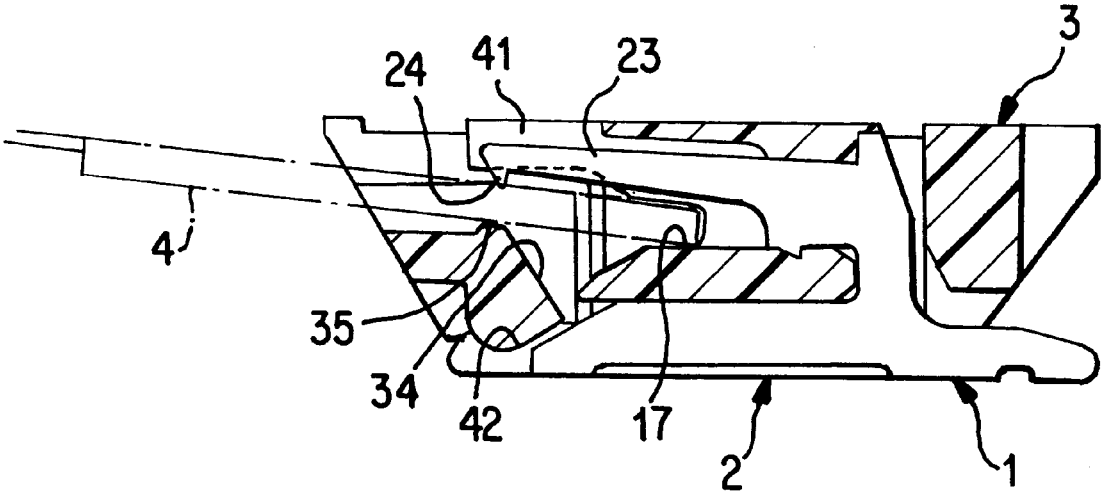
FIG. 9*b* is a cross-sectional view of FIG. 9*a*.
Figure 11:
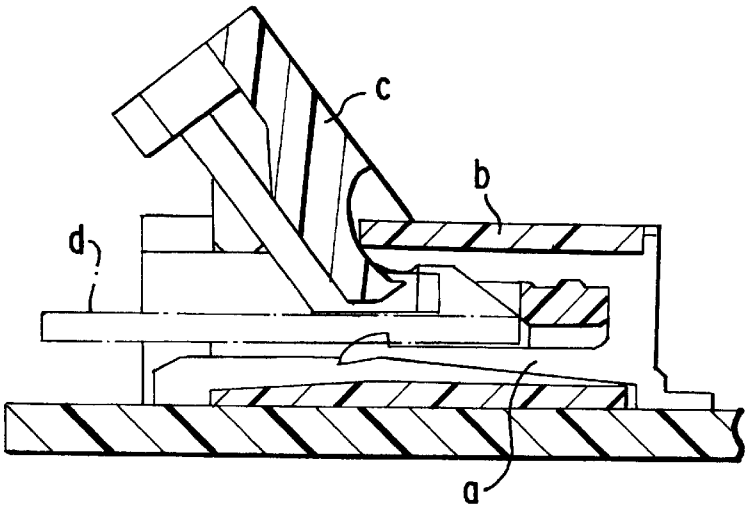
FIG. 11 PRIOR ART
FIG. 11 is a cross-sectional view of the prior art example.

The portion of the axle 33 which is located between the levers 32 has a modified shape cross-sectionally: its upper face comprises a straight guiding face 34 whose external edge has a clamping supporting member 35. The ribbon cable 4 is clamped and supported between the contact 24 and this clamping supporting member 35. That is, as shown in FIG. 9*a*, when the pressing member 3 is in the pressing position it is approximately horizontal. As shown in FIG. 9*b*, the clamping supporting member 35 faces the contact 24 and is open to a smaller dimension than the thickness of the ribbon cable 4. As shown in FIG. 8*a*, when the pressing member 3 is in the releasing position, it is at an angle of approximately 45° and, as shown in FIG. 8*b*, the clamping supporting member 35 moves downwards and forms a space relative to the contact 24 which is larger than the thickness of the ribbon cable 4. Moreover, the guiding face 34 assumes an approximately horizontal condition and performs the function of guiding the ribbon cable 4 at the time of its insertion.

This embodiment is provided with a main stopping means which latch the pressing member 3 in the pressing position, and a temporary stopping means which latch the pressing member 3 in a temporary supporting position slightly above the pressing position. These are described below in detail.

As shown in FIG. 1, the width of the outer faces of the base portions of the levers 32 located on the pressing member 3 is reduced to form narrow width members 36. When the pressing member 3 is installed in the housing 1 in the manner described above, as shown in FIG. 4, the narrow width members 36 fit with the inner sides of the locking columns 13 of the housing 1. As shown in detail in FIG. 5, stopping protrusions 37 are formed on the external faces of the narrow width members 36, and inclined faces 38 are formed on the lower angled portions of the protrusions 37.

A first projecting member 44 is formed at the top of the inside face of the upper end of the locking columns 13, and a second projecting member 45 is formed at a specified distance below it. This second projecting member 45 is thicker and projects further than the first projecting member 44. Inclined faces 46 and 47 are formed on the upper and lower angles of the first projecting member 44, and an inclined face 48 is formed on the upper angle of the second projecting member 45. The space between the projecting members 44 and 45 forms a temporary stopping concave recess 50, and below the projecting member 45 is a main stopping concave recess 51. As will be explained in detail below, the stopping protrusion 37 fits with the recess 50, as in FIG. 6*a*, and with the recess 51, as in FIG. 6*b*. The fitting is shallower in the case of recess 50 than in the case of the recess 51.

Figure 6A:
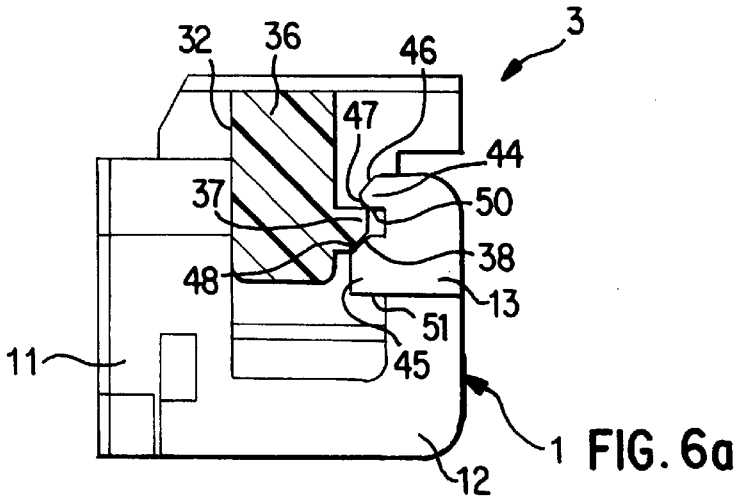
FIG. 6*a* is a partially cut away rear view showing the temporary stopping position.

The operation of this embodiment is as follows:

The terminal 2 is attached to the housing 1. After the pressing member 3 is attached, it is prevented from moving by being retained in the housing 1 until the connector is attached to the circuit board and the ribbon cable 4 is inserted. The base member 31 of the pressing member 3 is pivoted with a comparatively mild rotative force toward the pressing position using the axle 33 as its centre. Thereupon, as shown in FIG. 6*a*, the stopping protrusion 37 is guided by the inclined faces 38 and 46, fits with the temporary stopping recess 50, and is latched therein. The inclined face 38 of the stopping protrusion 37 faces the inclined face 48 of the second projecting member 45 and, as it only slightly touches the ceiling portion of the temporary stopping concave member 50, it fits in a shallow manner (FIG. 6*a*). As a result, the fitting force is comparatively weak. Consequently, as shown in FIGS. 7*a* and 7*b*, when the pressing member 3 is in a position slightly above the pressing position, when raised slightly, it can be temporarily supported in the housing 1. As a result, the pressing member 3 does not move during transportation or during attachment to a circuit board. Furthermore, handling becomes easy since the pressing member 3 is kept housed in a compact manner.

When the ribbon cable 4 is to be inserted after the connector has been fixed to a circuit board, the pressing member 3 is pivoted to the releasing position. The anterior ends of the lever 32 are pushed, and the pressing member 3 is rotated in a counter-clockwise direction relative to FIG. 7*a*. At this juncture, the stopping protrusion 37 is guided by the inclined face 47 at the lower side of the first projecting member 44 and slips out of the temporary stopping recess 50. As mentioned above, the stopping force is relatively weak and as a result the pressing member 3 can easily be moved to the releasing position shown in FIG. 8.

When the pressing member 3 has been pivoted to the releasing position, the ribbon cable 4 is inserted into the housing 1 through the mouth 16. As shown in FIG. 8*b*, the ribbon cable 4 is guided by the guiding face 34 of the axle 33 and is received within the concave groove 17. Insertion halts when the ribbon cable 4 meets the interior end of the concave groove 17.

Next, the base member 31 is pushed in strongly and the pressing member 3 is pivoted in a clockwise direction relative to FIG. 8*a* and the pressing position shown in FIG. 9*a* is attained. Thereupon, the resilient contact member 23 of the terminal 2 bends and the ribbon cable 4 is clamped between the clamping supporting member 35 and the contact 24, and electrical contact is established between the ribbon cable 4 and the terminal 2.

Figure 6B:
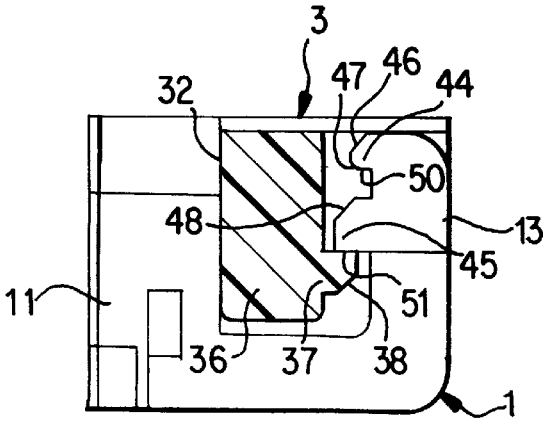
FIG. 6*b* is a partially cut away rear view showing the main stopping position.

At this juncture, as shown in FIG. 6*b*, the stopping protrusion 37 passes over the temporary stopping recess 50 and then, guided by the inclined faces 38 and 48, fits with the main stopping recess 51. In this case, the stopping protrusion 37 is fitted deeply with the main stopping recess 51, and a strong stopping force is achieved. As a result, even if a pulling force or the like is exerted on the ribbon cable 4, the pressing member 3 is not easily displaced from the pressing position.

According to the embodiment described above, the pressing member 3 is latched with a strong stopping force when it is in the pressing position, and consequently the contact between the ribbon cable 4 and the terminal 2 is securely maintained. That is, the reliability of the connection is high. On the other hand, since the pressing member 3 is stopped in the temporary supporting position with comparatively weak stopping force, while the ribbon cable 4 is being connected the pressing member 3 can easily be moved to the releasing position.

Furthermore, the present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the pressing member 3 is configured so as to be movable in a seesaw fashion. However, a connector in which one end of the pressing member 3 acts as the centre of rotation and the other end moves up and down may equally be applied to the present invention.

(2) Further, the present invention is also applicable in the case of a flat cable connector in which a plurality of round electric wires are aligned and flat layers of resin film are formed on their outer and inner faces.

I claim:

1. An electrical connector for a flat conductor having an electrical path thereon, said connector comprising a housing, an electrical terminal in the housing, and a pressing member pivotally mounted on said housing about a pivot axis and rotatably movable between three positions including an open position in which the pressing member and housing together define a mouth open to receive a flat conductor, a partially closed position in which said mouth is partially closed and said pressing member is prevented from rotating to said open position and a closed position in which said mouth is closed to clamp said conductor against said terminal and said pressing member is prevented from rotating to said partially closed and open positions, said connector also including an initial latch that applies a first latch force to said pressing member for holding said pressing member in said partially closed position and preventing rotational movement of said pressing member, and a final latch that applies a second latch force to said pressing member for holding said pressing member in said closed position, said second latch force being greater than said first latch force.

2. A connector according to claim 1 wherein said initial and final latches have a common latching member.

3. A connector according to claim 2 wherein said common latching member is a protrusion.

4. A connector according to claim 3 wherein said initial and final latches include respective recesses for engagement by said protrusion.

5. A connector according to claim 4 wherein said protrusion extends further along the recess of said final latch than along the recess of said initial latch.

6. A connector according to claim 3 wherein said protrusion is provided on said pressing member.

7. A connector according to claim 4 wherein said protrusion is provided on said pressing member.

8. A connector according to claim 5 wherein said protrusion is provided on said pressing member.

9. A connector according to claim 1 wherein the initial latch and the final latch are provided on one side of said pressing member adjacent said pivot axis and another initial latch and final latch are provided on a second side of said pressing member adjacent said pivot axis.

10. A connector according to claim 1 wherein said connector housing and pressing member are respective one piece plastics mouldings snap-fitted together.

11. A connector according to claim 10 wherein said initial latch and final latch comprise a resiliently engageable protrusion engageable in a recess.

12. A connector according to claim 11 wherein one of said protrusion and recess include a chamfered contact portion to facilitate engagement thereof.

13. A connector according to claim 2 wherein said housing includes a locking column for receiving said common latching member, and said initial and final latches each include a respective projecting member extending inwardly from a surface of said locking column.

14. A connector according to claim 13 wherein the projecting member of said final latch extends a greater distance into said locking column than the projecting member of the initial latch.

15. A connector according to claim 14 wherein said projecting member of the initial latch is positioned at a first point along a height of the locking column and said projecting member of said final latch is positioned at a second point along the height of the locking column so that said common latching member passes the projecting member of the initial latch as it is being moved toward the projecting member of the final latch.

* * * * *